US005821449A

United States Patent [19]

Langsjoen et al.

[11] Patent Number: 5,821,449

[45] Date of Patent: Oct. 13, 1998

[54] PROPELLANT GRAIN GEOMETRY FOR CONTROLLING ULLAGE AND INCREASING FLAME PERMEABILITY

[75] Inventors: Peter L. Langsjoen, St. Louis Park, Minn.; James A. Speck, Waterford, Mich.

[73] Assignee: Alliant Techsystems Inc., Hopkins, Minn.

[21] Appl. No.: 535,435

[22] Filed: Sep. 28, 1995

[51] Int. Cl.[6] ..... C06B 45/00

[52] U.S. Cl. ..... 102/288; 102/289

[58] Field of Search ..... 102/288, 289

[56] References Cited

U.S. PATENT DOCUMENTS

| | | | |
|---|---|---|---|
| 404,053 | 5/1889 | Quick | 102/288 |
| 694,295 | 2/1902 | Maxim | 102/289 X |
| 1,074,809 | 10/1913 | Newton | 102/289 X |
| 1,077,320 | 11/1913 | Walsh | 102/288 |
| 3,105,350 | 10/1963 | Eichenberger | 60/35.3 |
| 3,418,811 | 12/1968 | Caveny et al. | 60/254 |
| 3,429,264 | 2/1969 | Oversohl et al. | 102/100 |
| 3,931,765 | 1/1976 | Portalier et al. | 102/99 |
| 4,094,248 | 6/1978 | Jacobsen | 102/100 |
| 4,466,352 | 8/1984 | Dalet et al. | 102/288 |
| 4,627,352 | 12/1986 | Brachert et al. | 102/290 |
| 4,846,368 | 7/1989 | Goetz | 102/288 X |
| 5,251,549 | 10/1993 | Boisseau et al. | 102/289 |

OTHER PUBLICATIONS

"Dimensions of Grains", Method 504.1.1, MIL–STD–286B, 1 Dec. 1967, pp. 1–3.

Krier, Herman et al., "An Introduction to Gun Interior Ballistics and a Simplified Ballistic Code", University of Illinois at Urbana–Champaign, Urbana, IL, ©American Institute of Aeronautics and Astronautics, Inc., 1979, pp. 1–36.

May, Ingo W. et al., "Charge Design Considerations and Their Effect on Pressure Waves in Guns", Ballistic Reserach Laboratory, Aberdeen Proving Ground, MD, pp. 197–227.

Shimpi, Shirish A. et al., "The Closed Bomb Test for the Assessment of Solid Propellant Grains Utilized in Guns", *Combustion and Flame*, vol. 25, ©1975 by The Combustion Institute, pp. 229–240.

Thynell, S.T. et al., "Transient Combustion Behavior of Thin Propellant Disks", Department of Mechanical Engineering, The Pennsylvania State University, University Park, PA 16802.

*Primary Examiner*—Peter A. Nelson
*Attorney, Agent, or Firm*—George A. Leone

[57] ABSTRACT

A hollow grain propellant for use in a lightweight training round. The hollow grain propellant incorporates multi-perforation propellant grain geometry. The hollow grain propellant is configured as a propellant grain having a center hole surrounded by uniform perforations. The center hole is larger than any one of the uniform perforations. The placement of the uniform perforations forms webs of equal length. The hollow grain propellant may include seven or more perforations. The perforations are arranged in a single ring around the center hole. The size of the center hole may be controlled to produce a wide range of bulk densities. The number of perforations may be dependant on the size of the center hole. The number of perforations may be controlled to vary with the size of the center hole to provide for a desired bulk density. The large center hole improves flame permeability through a propellant bed by increasing the porosity of the propellent bed and increasing grain diameter. The hollow grain geometry maintains good progressive burning characteristics at low bulk densities while retaining low mass fraction at slivering. The hollow grain propellant further eliminates the need to reduce ullage with costly spacers, fillers, or liners.

16 Claims, 10 Drawing Sheets

PROPELLANT GRAIN GEOMETRY FOR CONTROLLING ULLAGE AND INCREASING FLAME PERMEABILITY

This invention relates to a propellant grain geometry for controlling ullage, and more particularly to a propellant grain geometry for providing for a selected bulk density and improving flame permeability.

BACKGROUND OF THE INVENTION

Training rounds for tank ammunition may not require a full load of propellant. For example, a lightweight 120 mm training round for the Abrams M1A1/A2 tank main gun may require about 30% less propellant than a normal round. However, the training round propellant chamber volume is unchanged. This results in ullage, which is the free space remaining in a cartridge above the propellant bed. Ullage may cause problems such as destructive pressure waves, which at an extreme may result in breech blows. Ullage may also cause increased variability in shot velocity. Prior art solutions for ullage reduction such as liners, spacers or fillers are costly. Furthermore, these solutions may increase residue either through unburned liner, spacer or filler material or because the liner, spacer or filler material shields the cartridge case and prevents the cartridge case from burning out.

The prior art further includes multi-perforation grain geometries, such as those shown in FIGS. 1A, 1B, 1C, 1D, 2A and 2B. However, these multi-perforation grains have limited ability to decrease bulk density through increasing perforation diameter. Therefore, liners, spacers or fillers are often still necessary to sufficiently reduce ullage. Furthermore, increasing perforation diameter of conventional multi-perforation grains results in lower progressivity and a larger mass fraction at slivering.

It is therefore desirable to provide a new grain geometry that would allow bulk density to vary over a wide range without significantly changing progressivity or sliver fraction.

SUMMARY OF THE INVENTION

A multi-perforation propellant grain geometry for use in a lightweight training round. A hollow grain propellant comprises a propellant grain having a plurality of webs and a center hole surrounded by a plurality of uniform perforations. The plurality of uniform perforations each have a first cross-sectional width and the center hole has a second cross-sectional width which is larger than the first cross-sectional width such that the plurality of webs are of equal length.

In one aspect of the invention, the hollow grain propellant may include seven or more perforations. The perforations are arranged in a single ring around the center hole. The size of the center hole may be controlled to produce a wide range of bulk densities. The number of perforations may be dependant on the size of the center hole. The number of perforations may be controlled to vary with the size of the center hole to provide for a desired bulk density. The larger center hole improves flame permeability through a propellant bed by increasing the porosity of the propellent bed and increasing grain diameter. The hollow grain geometry maintains good progressive burning characteristics at low bulk densities while retaining low mass fraction at slivering. The hollow grain propellant further eliminates the need to reduce ullage with costly spacers, fillers, or liners.

Other objects, features and advantages of the present invention will become apparent to those skilled in the art through the description of the preferred embodiment, claims and drawings herein wherein like numerals refer to like elements.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

The invention provides a hollow grain propellant geometry for reducing ullage and improving flame permeability. The hollow grain propellant geometry allows for a reduction in bulk density without substantially degrading performance characteristics. Factors important in maintaining performance of propellant grain include progressivity and slivering. Progressivity is a measure of the change in total surface area of a grain as it burns. Multi-perforated grains increase total surface area during burning because the perforations increase in area faster than the outside area decreases. In most applications progressivity is desirable. Slivering occurs when the burning surfaces meet with each other and the grain breaks up into generally triangular shaped slivers. This point is termed the point of slivering. After the point of slivering, burning is regressive as surface area decreases rapidly. Progressivity may be measured as the ratio of surface area at the point of slivering with respect to the initial surface area.

Performance is also affected by the flame permeability of propellant grains in a propellant bed. Flame permeability is a measure of the ease with which a flame front moves through a propellant bed. Flame permeability increases with increasing porosity of a propellant bed and increasing grain diameter.

Figure 1A:
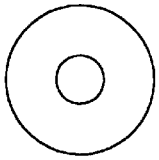
PRIOR ART Fig. 1A
FIGS. 1A, 1B, 1C and 1D show conventional cylindrical grain propellant configurations.
Figure 1B:
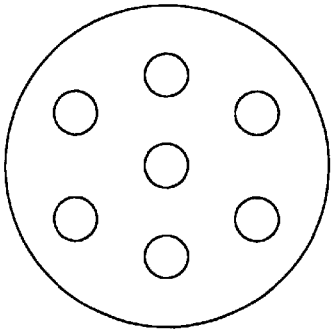
PRIOR ART Fig. 1B
Figure 1C:
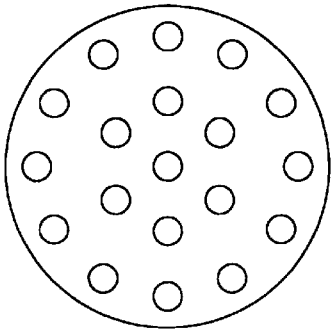
PRIOR ART Fig. 1C
Figure 1D:
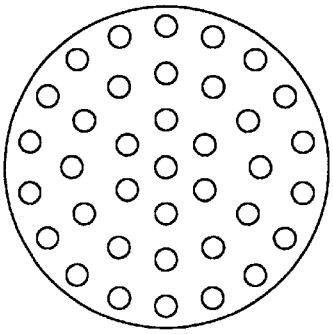
PRIOR ART Fig. 1D
Figure 2A:
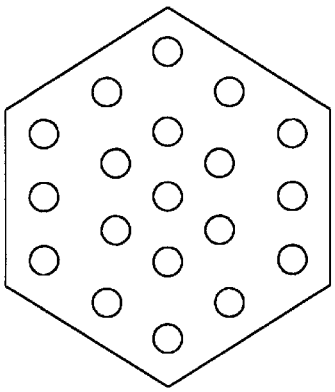
PRIOR ART Fig. 2A
FIGS. 2A and 2B show conventional hexagonal grain propellant configurations.
Figure 2B:
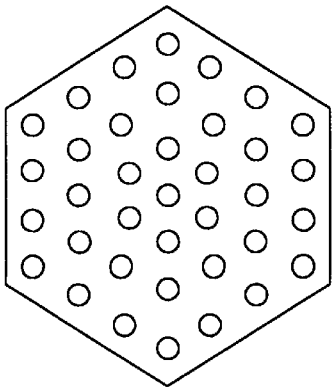
PRIOR ART Fig. 2B
Figure 3:
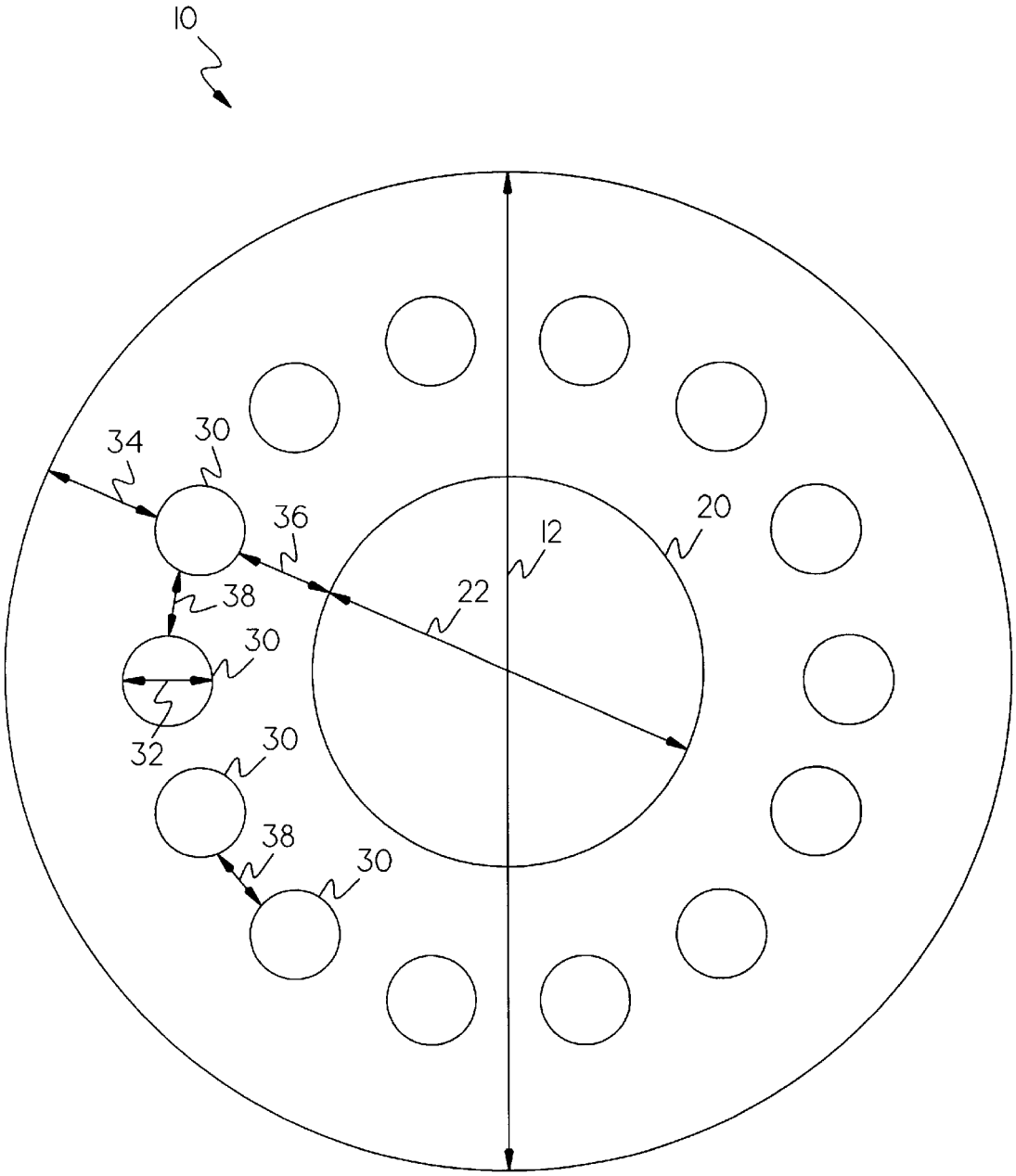
FIG. 3 shows the hollow grain propellant of the invention.
Figure 4A:
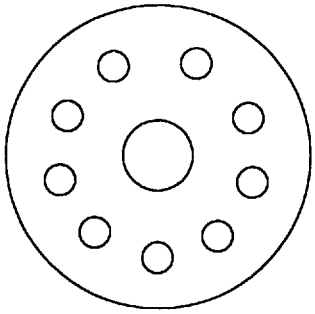
FIGS. 4A–4H show hollow grains having seven to fourteen perforations.
Figure 4B:
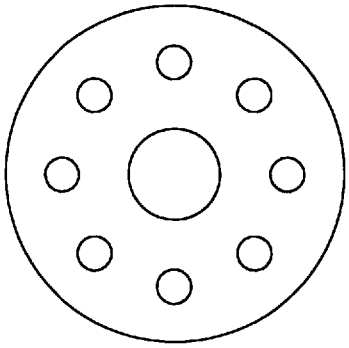
Figure 4C:
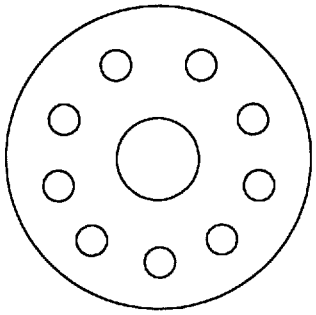
Figure 4D:
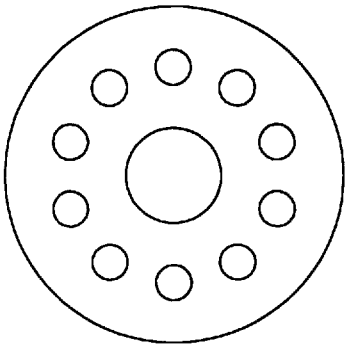
Figure 4E:
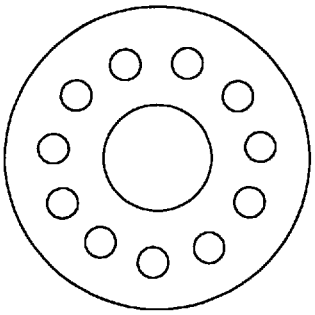
Figure 4F:
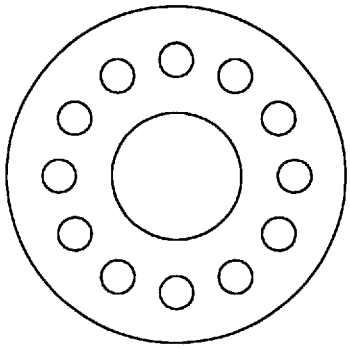
Figure 4G:
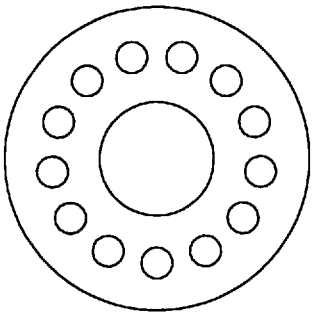
Figure 4H:
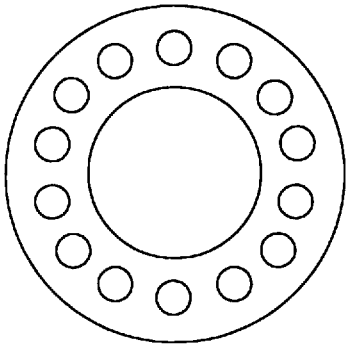

Now referring to FIG. 3 which shows one embodiment of the hollow grain propellant of the invention. The hollow grain propellant 10 has a larger grain diameter (OD) 12 than conventional seven grain propellants and further comprises a center hole 20 surrounded by a plurality of smaller uniform perforations 30. The plurality of smaller uniform perforations 30 may be arranged in a single ring pattern around the center hole 20. The center hole 20 provides for low bulk density and increased grain diameter with respect to standard grain propellants. The center hole 20 also increases porosity of the propellant bed. The increased porosity of the propellant bed along with the larger grain diameter increase flame permeability.

The hollow grain propellant 10 further comprises an outer diameter (OD) 12 and an inner diameter (ID) 22. The inner diameter 22 defines the central hole 20. The hollow grain propellant 10 further includes a plurality of perforations 30 having a perforation diameter (d) 32. The outer diameter 12, the inner diameter 22, the perforation diameter 32 and the number of perforations 30 define web measurements. The web measurements may include an outside web ($W_o$) 34, an inside web ($W_i$) 36 and a side web ($W_s$) 38. The outside web 34 measures the shortest distance from an outer edge of the perforation 30 to the outer surface of the propellant grain 10. The inside web 36 measures the shortest distance from an inner edge of the perforation 30 to the surface of the inside diameter 22. The side web 38 measures the shortest distance from the edge of one perforation 30 to the edge of an adjacent perforation 30. In one preferred embodiment of the invention, both the inner diameter 22 and the outer diameter 12 are functions of the number of perforations 30 selected (n), the perforation diameter 32, and the web size (w).

In the case where all web measurements are equal, the inner diameter 22 and the outer diameter 12 may be expressed as:

$$ID = \frac{(w+d)}{\sin(180/n)} - 2w - d \quad (1)$$

$$OD = ID + 4w + 2d \quad (2)$$

Where:

ID=inner diameter;

OD=outer diameter;

w=web size;

d=perforation diameter; and n=number of perforations selected.

The hollow grain, when reduced to 6 perforations and web size is held constant for all three web measurements, becomes a conventional seven perforation cylindrical grain, typically abbreviated (7p cyl), as the center hole is reduced to the same diameter as the perforations. As perforations are added, the center hole 20 and grain diameter 12 grow in size providing for increasingly lower bulk densities.

When the side web ($W_s$) 38 measurement differs from the outside web 34 and the inside web 36, the side web 38 measurement may be determined using the following equation:

$$W_s=(ID+2W_i+d)*\sin(180/n)-d \quad (3)$$

Where:

$W_s$=side web; and $W_i$=inside web.

In one embodiment of the invention, a bulk density of a hollow grain propellant may be controlled through selecting a number of perforations 30. Increasing the number of perforations 30 decreases the bulk density. The number of perforations 30 may be increased up to w practical limits. Grain fracturing and manufacturing constraints are physical restrictions on grain geometry. Using the hollow grain geometry of the invention, bulk density reductions up to about 33% have been demonstrated.

Figure 6:
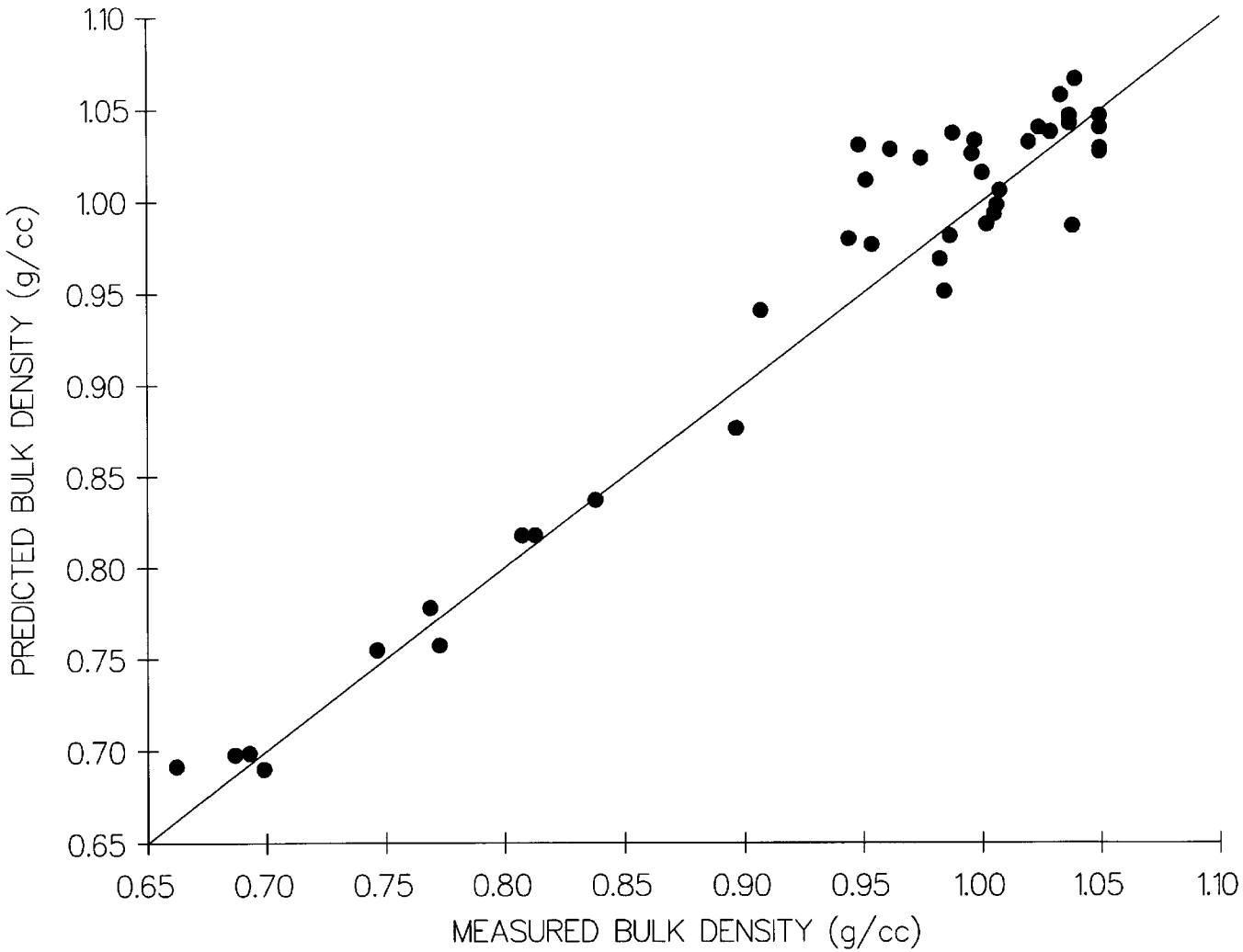
FIG. 6 shows a graph of predicted bulk density versus measured bulk density.

Equation 4 below may be used to predict bulk density based on absolute density and grain dimensions. This equation predicts bulk densities for a variety of grain geometries including 1p cyl, 7p cyl, 19p cyl, 19p hexagonal, and hollow grain. The equation has been tested for 120 mm munitions. Refer now to FIG. 6 which shows a graph of predicted bulk density versus measured bulk density. A test showed accuracy within ±5% for 90% (40 of 44) of the lots evaluated. The largest individual discrepancy was 7.9%.

$$\text{Bulk Density}=SF*ad*K*f(L:D) \quad (4)$$

where:

SF=solid fraction=actual end area/effective end area;

ad=absolute density of propellant (g/cc);

K=packing constant (including unit conversions); and f(L:D)=function relating L:D ratio to K1.

These quantities are determined as shown below.

Solid Fraction

SF=AEA/EEA where:

AEA=actual end area=$\pi(z(OD/2)^2-c(ID/2)^2-n(d/2)^2)$;

EEA=effective end area=$z\,\pi(OD/2)^2$;

OD=outside diameter of grain;

ID=inside diameter (hollow grain only);

d=average perforation diameter (exclude center hole of hollow grain);

n=number of perforations (exclude center hole of hollow grain);

z=1 for cylindrical grains, z=0.826993 for hexagonal grains;

c=1 for hollow grain; and c=0 for all other grains.

Absolute Density ad=absolute density per MIL-STD-286B, Method 510.1.1 Absolute density typically ranges from 1.51 to 1.68 g/cc. 1.58 g/cc may be used as a rough approximation if a reported value is not available.

Packing Constant

K=packing constant (K=42.3 for English dimensions, L:D=1, graphited grains).

The packing constant is determined using the following procedure:

1. Calculate K1 for each lot, where K1=Measured Bulk Density/(SF*ad);
2. Plot K1 as a function of L:D and fit to an equation using linear regression; and
3. Determine K at L:D=1 from the equation above.

Length to Diameter Function f(L:D)=1.046–0.046*L:D (where K is based on English dimensions).

This is a linear regression fit of L:D to K1, where L:D ranges from 1.0 to 3.9.

Figure 5A:
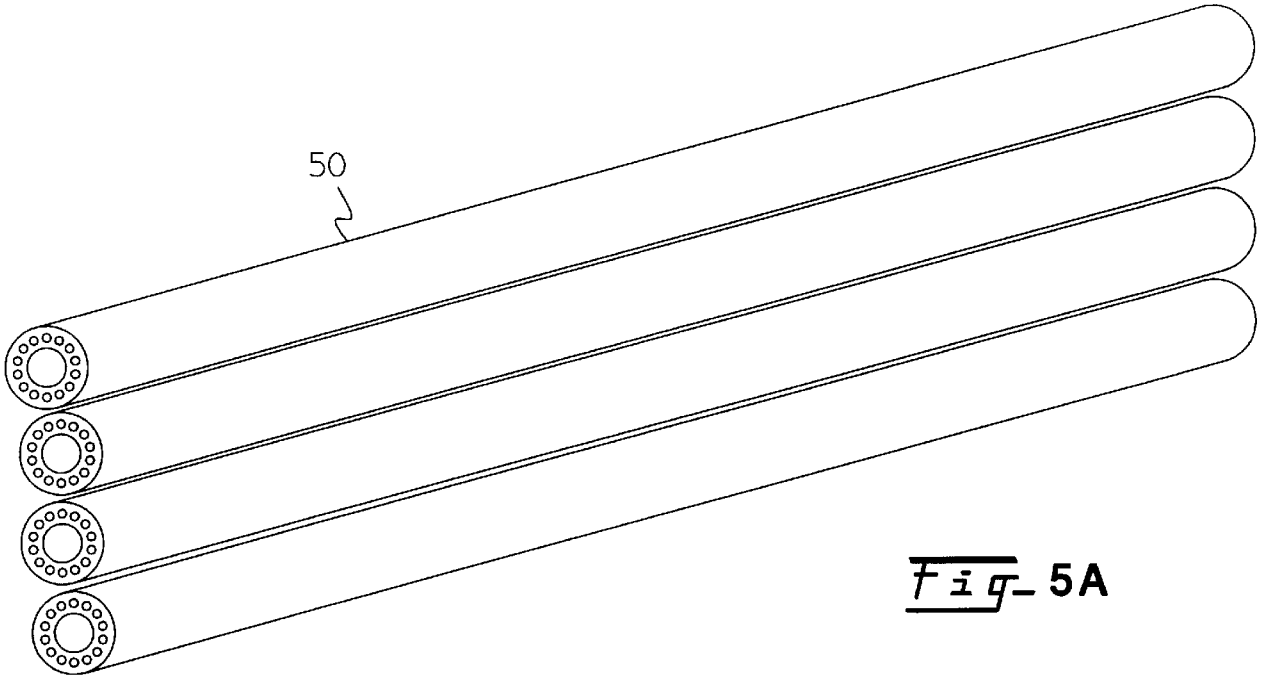
FIG. 5A shows an example of an example embodiment of the hollow grain propellant having a stick configuration.
Figure 5B:
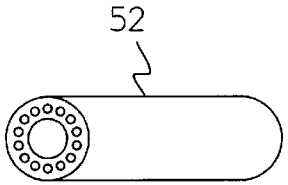
FIG. 5B shows an example of an example embodiment of the hollow grain propellant having a granular configuration.

The hollow grain geometry further provides for a wide range of bulk densities without significant alteration of burning characteristics or ballistic performance. This is possible because bulk density in the hollow grain is controlled by geometry and not by perforation diameter as compared to conventional grains. FIGS. 4A–4H show hollow grains having seven to fourteen perforations, for example. The hollow grain concept applies to stick propellants 50 and granular propellants 52, as shown in FIGS. 5A and 5B.

In conventional grains, increasing perforation diameter 32 decreases bulk density. The propellent of the present invention provides for decreasing bulk density by increasing the number of perforations 30.

Figure 7:
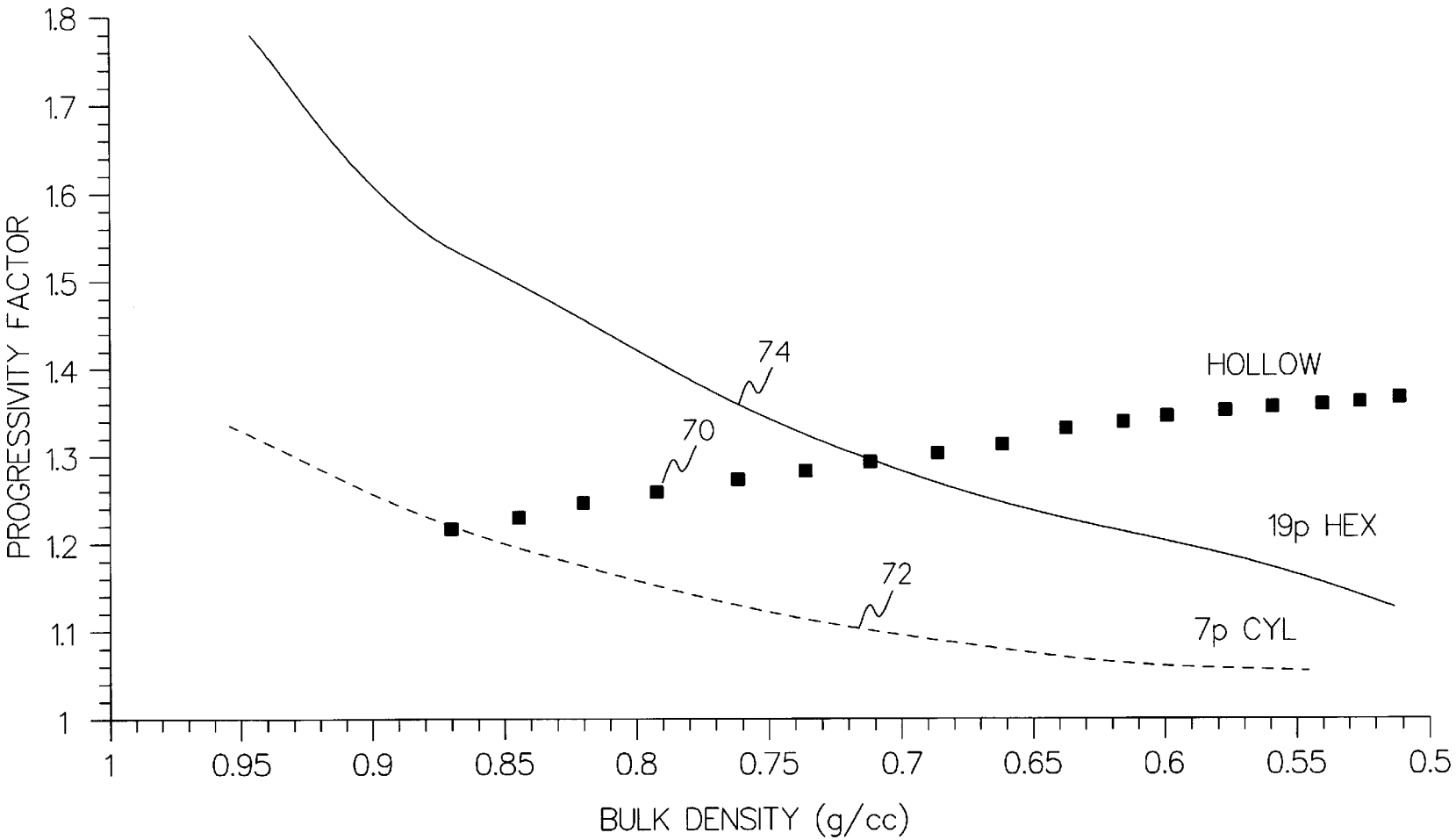
FIG. 7 shows a comparison of progressivity versus bulk density for three types of geometries.
Figure 8:
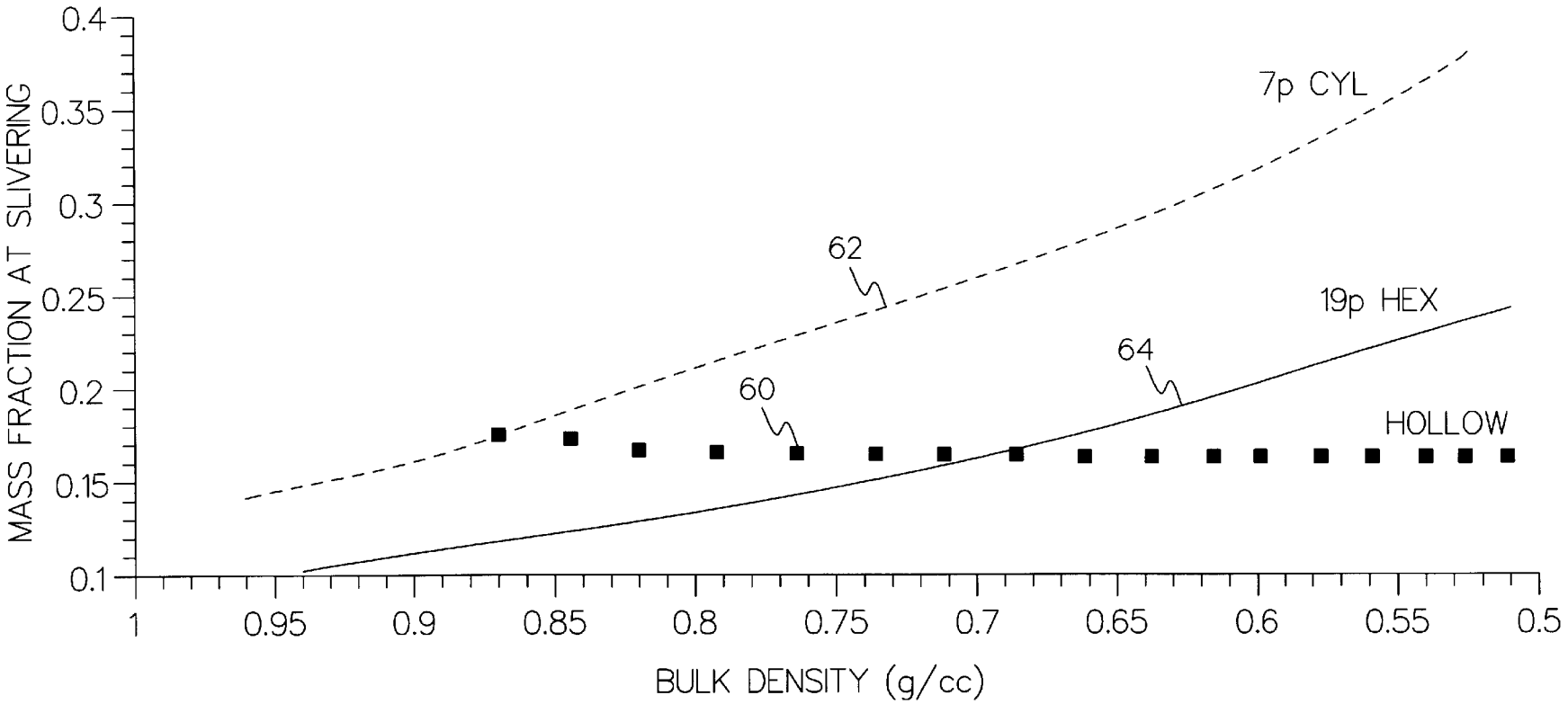
FIG. 8 shows a comparison of sliver fraction versus bulk density for three types of geometries.

FIGS. 7 and 8 are graphs based on computer simulations that show advantages of the hollow grain propellant of the invention in maintaining progressivity and sliver fraction in comparison to standard grains. In the computer simulations, the grains' web and L:D were held constant at 0.051 cm (0.020 in) and 2:1 respectively. The hollow grain perforation diameter is held constant at 0.051 cm (0.020 in).

Refer now specifically to FIG. 7 which shows a comparison of progressivity versus bulk density for the hollow grain 70, seven perforation cylindrical grain 72, and 19 perforation hexagonal grain 74 in a computer simulation. Refer also to FIG. 8 which shows a comparison of sliver fraction versus bulk density for the hollow grain 60, seven perforation cylindrical grain 62, and 19 perforation hexagonal grain 64 in a computer simulation. The computer simulations indicated that the hollow grain has lower bulk density and improved sliver fraction over all seven perforation cylindrical grains with equal or larger perforation diameters. The hollow grain shows an improvement over the 19 perforation hexagonal grain at bulk densities below 0.71 g/cc (44.3 lb/ft$^3$). This bulk density corresponds to a 12 perforation hollow grain. The hollow grain also shows improved sliver fraction over the 19 perforation hexagonal grain at bulk densities below 0.71 g/cc (44.3 lb/ft$^3$). The hollow grain geometry therefore has a performance advantage for bulk densities below this point, since both progressivity and sliver fraction are improved over that of the 19 perforation hexagonal grain.

As shown in FIGS. 7 and 8, progressivity and sliver fraction remain relatively constant as the number of perforations is increased. Therefore, ballistic performance also remains relatively constant. Table 1 shows the predicted performance of three hollow grain configurations having nine, twelve and 15 perforations where web measurements and perforation diameter are the same for each case. The predictions are based on IBHVG2 simulations for which muzzle velocity was held constant. IBHVG2 is a lumped-parameter interior ballistic computer code developed and maintained by Army Research Laboratory.

TABLE 1

Hollow Grain Predicted Performance vs No. Perforations

| CHARACTERISTIC | 9 PERF | 12 PERF | 15 PERF |
|---|---|---|---|
| Muzzle Velocity | 1740 mps (5709 fps) | 1740 mps (5709 fps) | 1740 mps (5709 fps) |
| Breech Pressure | 3156 bars (45774 psi) | 3175 bars (46050 psi) | 3184 bars (46180 psi) |
| Charge Weight | 4.466 kg (9.846 lbs) | 4.461 kg (9.835 lbs) | 4.459 kg (9.830 lbs) |
| Bulk Density | 0.819 g/cc (51.1 lb/ft$^3$) | 0.737 g/cc (46.0 lb/ft$^3$) | 0.665 g/cc (41.5 lb/ft$^3$) |

In one embodiment of the invention, the hollow grain propellant satisfies design constraints sufficient to be incorporated into a projectile having the following specifications:

3.89 kg projectile;

2500 bar maximum base pressure at +63° C.;

1700 mps muzzle velocity at +21° C.; and 3200 lb-sec minimum impulse at +21° C.

Radford Army Ammunition Plant produced three pilot lots of 14 perforation hollow grain propellant. Table 2 provides a summary of the die dimensions, the finished grain dimensions, and the calculated shrinkage factors for three pilot lots.

TABLE 2

Physical Parameters of Die Sets and Finished M14 Propellant
Units: cm (in)

| PHYSICAL PARAMETER | LOT RADPD1H367-9 | LOT RADPDIH367-10 | LOT RADPDIH367-11 | AVERAGE SHRINKAGE |
|---|---|---|---|---|
| Agate Size | .991 (.390) | .988 (.389) | .978 (.385) | |
| Grain OD | .668 (.263) | .663 (.261) | .650 (.256) | |
| Shrinkage | 32.6% | 32.9% | 33.5% | 33.0% |
| Center Pin | .478 (.188) | .480 (.189) | .475 (.187) | |
| Grain ID | .335 (.132) | .333 (.131) | .338 (.133) | |
| Shrinkage | 29.8% | 30.7% | 28.9% | 29.8% |
| Outer Pins | .074 (.029) | .066 (.026) | .064 (.025) | |
| Grain Perf | .057 (.022) | .051 (.020) | .050 (.020) | |
| Shrinkage | 22.8% | 23.1% | 21.2% | 22.4% |
| Pin Circle | .734 (.289) | .734 (.289) | .732 (.288) | |
| Perf Circle (1) | .490 (.193) | .493 (.194) | .498 (.196) | |
| Shrinkage | 33.1% | 32.9% | 32.0% | 32.7% |
| Die Web (2) | .091 (.036) | .094 (.037) | .094 (.037) | |
| Grain Web (3) | .055 (.022) | .057 (.022) | .054 (.021) | |
| Shrinkage | 40.0% | 39.7% | 42.6% | 40.8% |

(1) Perforation Circle = ID + p + 2*Wi
(2) Die Web = (Agate Size - Center Pin - 2*Outer Pin)/4
(3) Grain Web = (Wi + Wo)/2

A partial burn test determined the burn pattern of the hollow grain propellant and the relative depletion rates of the inner, outer and perforation surfaces. Table 3 summarizes the test results. The data from all 3 pilot lots have been averaged to show the general trends.

TABLE 3

| Partial Burn Test Summary | | | | | |
|---|---|---|---|---|---|
| Shim Size | .152 | .203 | .254 | SLOPE* | $r^2$ |
| Pressure bars (psi) | 377 (5463) | 442 (6408) | 583 (8456) | NA | NA |
| Web inner cm (in) | .0284 (.0112) | .0227 (.0089) | .0197 (.0077) | −.0086 (−.317) | .9678 |
| Web outer cm (in) | .0380 (.0150) | .0336 (.0132) | .0277 (.0109) | −.0102 (−.376) | .9926 |
| Web side cm (in) | .0259 (.0102) | .0175 (.0069) | .0160 (.0063) | −.0097 (−.357) | .8658 |
| OD cm (in) | .6690 (.2634) | .6586 (.2593) | .6594 (.2596) | −.0095 (−.350) | .6911 |
| ID cm (in) | .3630 (.1429) | .3599 (.1417) | .3706 (.1459) | .0075 (.276) | .4808 |
| Perf Dia. cm (in) | .0869 (.0342) | .0934 (.0368) | .0967 (.0381) | .0097 (.357) | .9671 |
| Length cm (in) | 1.412 (.5554) | 1.419 (.5585) | 1.426 (.5614) | .0150 (.553) | .9996 |

*change in dimension/change in shim size (dimensionless).

The results of this test show acceptable burn results over increasing burn time. Burn times increase with increasing shim size. A positive slope indicates an increasing dimension, while a negative slope indicates a decreasing dimension. Even burn rates over the inner, outer and perforation surfaces are desirable. As can be seen, the hollow grain propellant lots made in accordance with the invention have burn characteristics well within acceptable limits.

Another design constraint is to provide sufficient structural strength to the hollow grain propellant. If the grain does not have sufficient structural strength, cold fracturing may occur during combustion, resulting in increased and variable surface area and pressures. A particle impingement test, described below, indicated that the hollow grain propellant fractures more easily at cold temperatures. However, ballistic tests showed that the hollow grain propellant has sufficient structural strength for use under extreme cold field conditions.

The particle impingement test compared the impact velocity required to fracture the hollow grain propellant with that of a 19 perforation cylindrical grain of similar web, and with a seven perforation grain having an 82% larger web dimension. This test was conducted in the Hazards Analysis Sensitivity Lab at the Radford Army Ammunition Plant.

The test was conducted at both +32° C. (+90° F.) and −40° C. (−40° F.). After temperature conditioning, the grains were fired one at a time at a steel plate using an airgun with 20 foot conveyor tube. Particle velocity was measured with infrared photo sensors just before impact. If no damage to the grain occurred after three trials the velocity was increased. Grain fracture was defined as a split along at least ¼ of the grains length.

Table 4 summarizes the preliminary test data. At −40° C. (−40° F.) the hollow grain fractured at a lower velocity than the 19 perforation cylindrical grain and the 7 perforation grain. At +32° C. (+90° F. ) both the hollow grain and the 19 perforation grain showed better structural strength than the larger web seven perforation grain.

TABLE 4

| Minimum Grain Fracture Velocity | | |
|---|---|---|
| PROPELLANT GEOMETRY | −40° C. (−40° F.) | +32° C. (+90° F.) |
| 7 perforation cyl M14 | 4900 cm/sec (161 fps) | 4964 cm/sec (163 fps) |
| 19 perforation Cyl M14 | 4522 cm/sec (148 fps) | 5443 cm/sec (179 fps) |
| 14 perforation hollow M14 | 3479 cm/sec (114 fps) | 5431 cm/sec (178 fps) |

Ballistics tests show the performance of the propellant grains under field conditions. A ballistic test of the hollow grain propellant was conducted at Alliant Techsystems EMRTC test range. The test employed 3.825 kg (8.433 lb) aluminum slugs. A 9 round charge establishment test was conducted on pilot lot RADPDIH367-10, and a 9 round temperature sensitivity test was conducted on pilot lot RADPDIH367-11.

The tests showed that the hollow grain propellant demonstrated satisfactory performance. The charge establishment test predicted a charge weight of 5.060 kg (11.155 lbs), and gave a velocity/charge slope of 165 mps/kg (246 fps/lb), and a pressure/charge slope of 1585 bars/kg (10428 psi/lb). The hollow grain propellent demonstrated similar temperature sensitivity to a 19 perforation cylindrical propellant of similar web. Furthermore, the projectiles propelled by the hollow grain propellant did not demonstrate performance anomalies at ambient temperature or at temperature extremes.

A second ballistic test was performed at the same test range. A discarding sabot projectile propelled by hollow grain propellant showed satisfactory propulsion system and projectile performance. Average in bore flight weight was 3.891 kg (8.578 lbs). Muzzle velocity was 11 mps (36 fps) below the design velocity of 1700 mps (5577 fps) at ambient temperature. Negative delta pressures met the current M865 requirement of 345 bars (5000 psi) max. Table 5 summarizes the data from the ballistic test.

TABLE 5

| Hollow Grain Performance with a Discarding Sabot Projectile | | | | | | |
|---|---|---|---|---|---|---|
| COND. TEMP. | CHARGE WEIGHT | QTY FIRED | BREECH PRESSURE | MUZZLE VELOCITY | T4 TIME | MAXIMUM INDIVIDUAL NDP |
| −32° C. (−26° F.) | 5.060 kg (11.155 lbs) | 5 | 3191 bars (46282 psi) | 1639 mps (5377 fps) | 21.0 ms | 158 bars (2292 psi) |
| +21° C. (+70° F.) | 5.060 kg (11.155 lbs) | 13 | 3620 bars (52504 psi) | 1689 mps (5541 fps) | 14.2 ms | 226 bars (3278 psi) |
| +52° C. (+126° F.) | 5.060 kg (11.155 lbs) | 5 | 3921 bars (56869 psi) | 1714 mps (5623 fps) | 14.0 ms | 181 bars (2625 psi) |

TABLE 5-continued

Hollow Grain Performance with a Discarding Sabot Projectile

| COND. TEMP. | CHARGE WEIGHT | QTY FIRED | BREECH PRESSURE | MUZZLE VELOCITY | T4 TIME | MAXIMUM INDIVIDUAL NDP |
|---|---|---|---|---|---|---|
| +63° C. (+145° F.) | 5.195 kg (11.453 lbs) | 3 (PIMP) | 4243 bars (61540 psi) | 1752 mps (5748 fps) | 13.8 ms | 264 bars (3829 psi) |

Figure 9A:
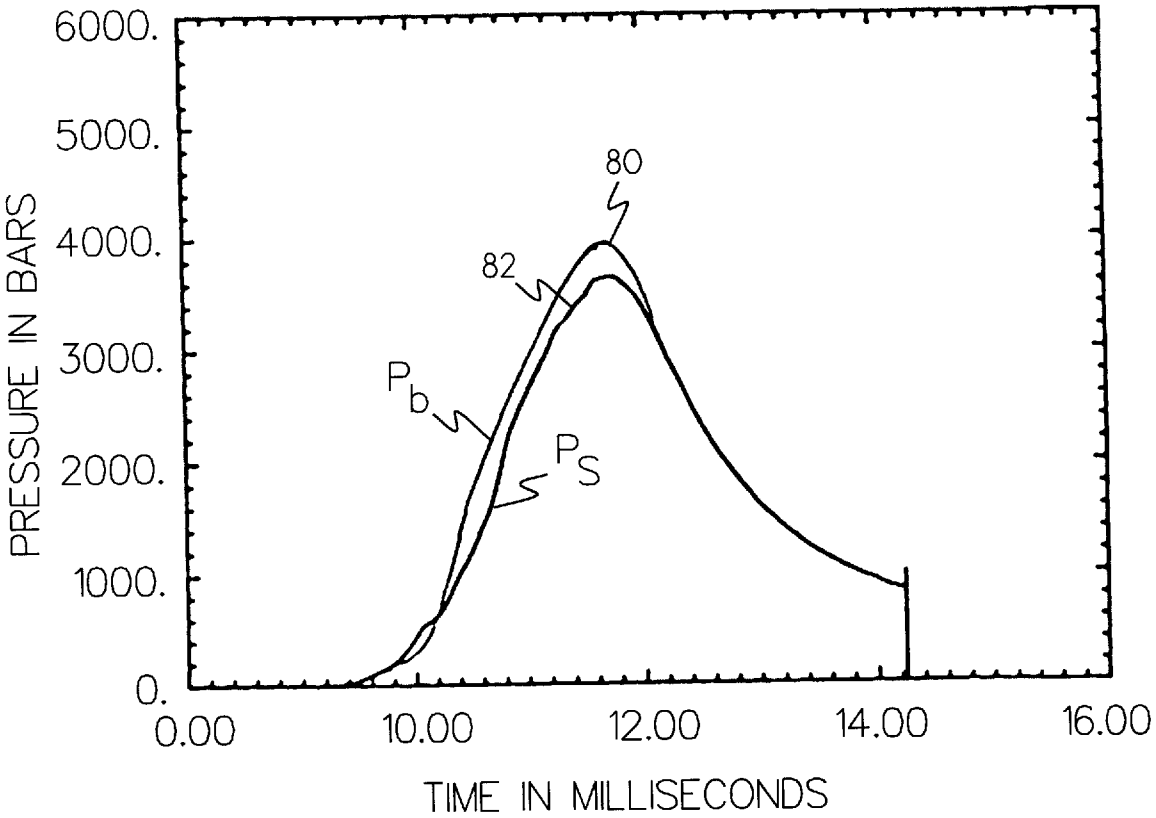
FIGS. 9A and 9B show a typical set of traces of pressure versus time.
Figure 9B:
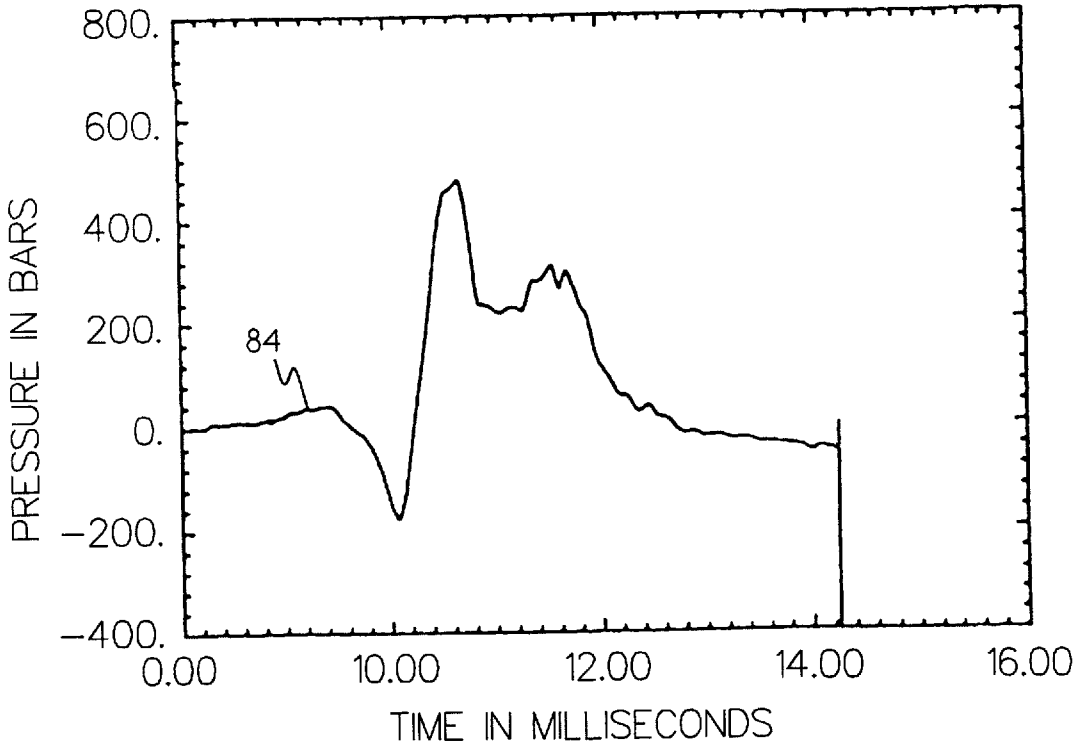

Refer now to FIGS. 9A and 9B which shows a typical set of traces of pressure versus time. FIG. 9A shows a graph of breech pressure ($P_b$) 80 and shoulder pressure ($P_s$) 82 versus time. FIG. 9B shows a graph of pressure differential 84 between breech pressure 80 and shoulder pressure 82 over time. The negative delta pressure should not fall below a −345 bar (−5000 psi) requirement. Cartridges equipped with the hollow grain propellant showed a negative delta pressure range of −106 to −264 bars (−1537 to −3829 psi). The pressure trace pattern was similar for each shot. An initial negative delta peak early in the cycle precedes a single larger positive delta peak. In these cases, the pressure waves dissipated before peak pressure was reached.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A multiperforated propellant grain geometry comprising a center perforation surrounded by a concentric ring having at least 7 perforations arranged and sized so as to form a plurality of webs having substantially equal length, wherein each of the at least 7 perforations includes a perforation diameter (d), and wherein the propellant grain includes an inner diameter (ID) related to the number of the at least 7 perforations (n), the perforation diameter (d), and by a desired web size (w) by the following equation $$\mathrm{ID} = \frac{w+d}{\sin(180/n)} - 2w - d.$$

2. The propellant grain geometry of claim 1 wherein an outside diameter (OD) of the propellant grain is related to the inside diameter (ID) of the grain, the desired web size (w) and the perforation diameter (d) by the following equation $$\mathrm{OD}=\mathrm{ID}+4w+2d.$$

3. The propellant grain geometry of claim 1 wherein a side web (Ws) is related to the inside diameter (ID) of the grain, to a desired inside web size ($W_i$) and to the perforation diameter (d) by the following equation $$W_s=(\mathrm{ID}+2W_i+d)*\sin(180/n)-d.$$

4. The propellant grain geometry of claim 1 wherein the center perforation inside diameter of the grain is at least 50% greater than the diameters of the at least 7 perforations in the surrounding ring.

5. The propellant grain of claim 1 wherein the webs formed between adjacent perforations, the inside diameter and the outside diameter are of substantially equal length.

6. A granular propellant configuration comprising a center perforation surrounded by a concentric ring having at least 7 perforations arranged and sized so as to form a plurality of webs having substantially equal length, wherein each of the at least 7 perforations includes a perforation diameter (d), and wherein the propellant grain includes an inner diameter (ID) related to the number of the at least 7 perforations (n), to the perforation diameter (d), and to a desired web size (w) by the following equation $$\mathrm{ID} = \frac{w+d}{\sin(180/n)} - 2w - d.$$

7. A multiperforated propellant grain geometry comprising a center perforation surrounded by a single concentric ring having at least 7 perforations arranged and sized so as to form a plurality of webs having substantially equal length, wherein each of the at least 7 perforations includes a perforation diameter (d), and wherein the propellant grain includes an inner diameter (ID) related to the number of the at least 7 perforations (n), to the perforation diameter (d), and to a desired web size (w) by the following equation $$ID = \frac{w+d}{\sin(180/n)} - 2w - d; \text{ and}$$

wherein an outside diameter (OD) of the propellant grain is related to the inside diameter (ID) of the grain, to the desired web size (w) and to the perforation diameter (d) by the following equation $$\mathrm{OD}=\mathrm{ID}+4w+2d.$$

8. The propellant grain geometry of claim 7 wherein a side web (Ws) is related to the inside diameter (ID) of the grain, to a desired inside web size ($W_i$) and to the perforation diameter (d) by the following equation $$W_s=(\mathrm{ID}+2W_i+d)*\sin(180/n)-d.$$

9. The propellant grain geometry of claim 8 wherein the center perforation inside diameter of the grain is at least 50% greater than the diameters of the at least 7 perforations in the surrounding ring.

10. The propellant grain of claim 7 wherein the webs formed between adjacent perforations, the inside diameter and the outside diameter are of substantially equal length.

11. The propellant grain geometry of claim 1 wherein the propellant further comprises a granular propellant grain.

12. The propellant grain geometry of claim 1 wherein the propellant further comprises a stick propellant grain.

13. The propellant grain geometry of claim 6 wherein the propellant further comprises a granular propellant grain.

14. The propellant grain geometry of claim 6 wherein the propellant further comprises a stick propellant grain.

15. The propellant grain geometry of claim 7 wherein the propellant further comprises a granular propellant grain.

16. The propellant grain geometry of claim 7 wherein the propellant further comprises a stick propellant grain.

* * * * *